US005452483A

United States Patent [19]

Dizon

[11] Patent Number: 5,452,483

[45] Date of Patent: Sep. 26, 1995

[54] BIDET APPARATUS FOR USE IN TOILET FIXTURES

[76] Inventor: Rafael J. Dizon, Jr., 4505 Eagle Rock Blvd., Los Angeles, Calif. 90041

[21] Appl. No.: 93,648

[22] Filed: Jul. 20, 1993

[30] Foreign Application Priority Data

Apr. 23, 1993 [PH] Philippines ..... 46094

[51] Int. Cl.[6] ..... A47K 4/00; E03D 9/08

[52] U.S. Cl. ..... 4/420.4; 4/448

[58] Field of Search ..... 4/420.1, 420.4, 4/420.5, 447, 448; 137/883; 251/274

[56] References Cited

U.S. PATENT DOCUMENTS

| | | | |
|---|---|---|---|
| 399,782 | 3/1889 | Richey | 251/274 X |
| 1,186,829 | 6/1916 | Pohlman | 251/274 X |
| 3,425,066 | 2/1969 | Berger | 4/420.4 |
| 4,181,985 | 1/1980 | Rius | 4/420.4 X |
| 4,642,820 | 2/1987 | Boring, Jr. | 4/420.4 |
| 4,644,972 | 2/1987 | Perrott | 137/883 |
| 4,782,861 | 11/1988 | Ross | 137/883 X |

FOREIGN PATENT DOCUMENTS

| | | |
|---|---|---|
| 0020050 | 9/1986 | Philippines . |
| 0020051 | 9/1986 | Philippines . |

*Primary Examiner*—Robert M. Fetsuga

[57] ABSTRACT

A bidet apparatus for use in toilet bowl of the type having a flush tank is disclosed. The apparatus defines a valve operated mechanism having a valve regulator, an associated valve seat housing, and a water conveyance block. The housing has a water leading hole in communication with a conveyance tube whose free end defines a directable spray nozzle. The block has an inlet and outlet passageways communicably connected through the leading hole. The inlet and outlet passageways are connected to the water supply source and the flush tank of the bowl, respectively. A mounting bracket for connection to the bowl is secured on the mechanism and laterally extends therefrom.

2 Claims, 3 Drawing Sheets

FIG. 1
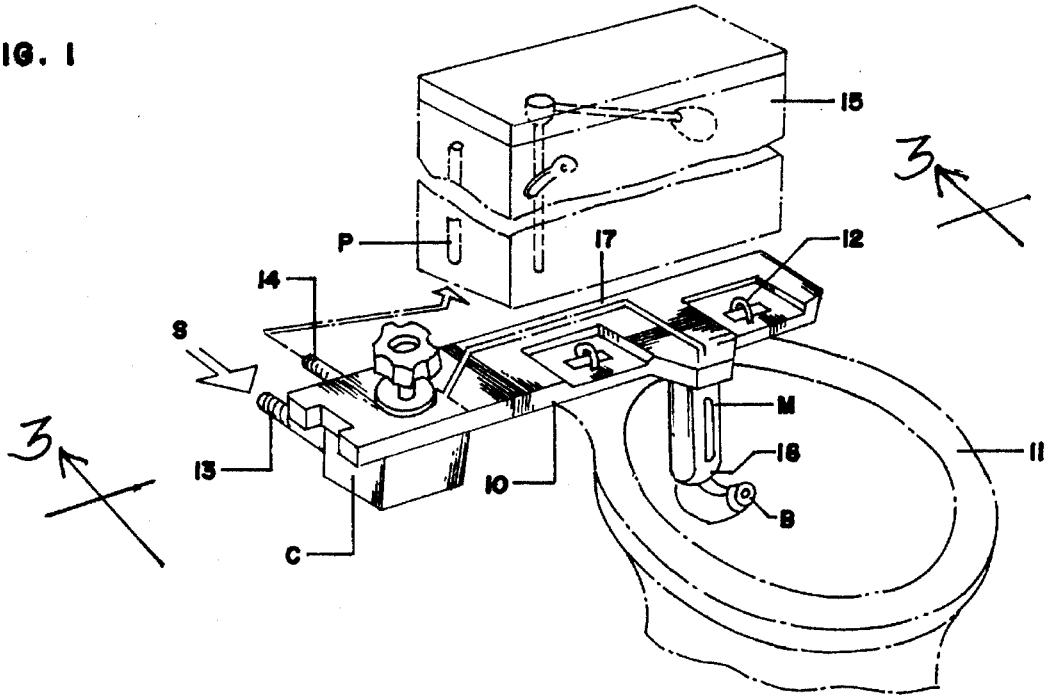
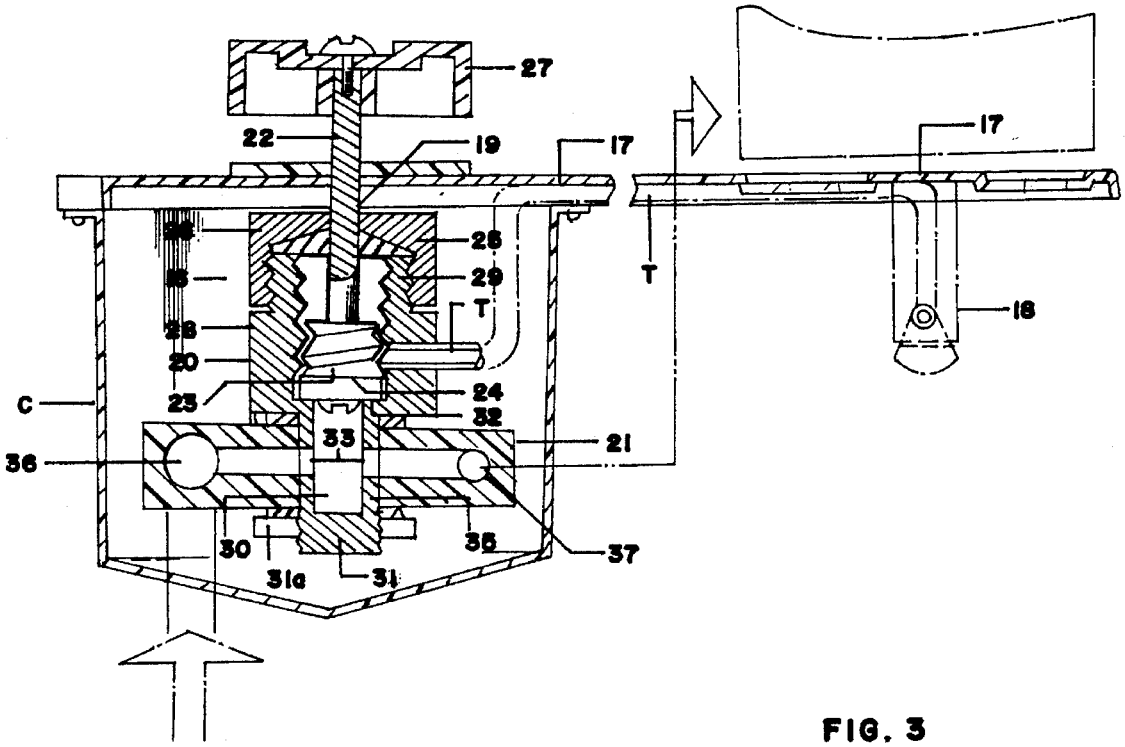
FIG. 3

BIDET APPARATUS FOR USE IN TOILET FIXTURES

This invention relates generally to spraying device.

More specifically, it relates to a hygienic bidet apparatus for use in conventional toilet bowls of the type having a water closet or flush tank.

With the sustained effort coupled with the desire to introduce innovations and/or modifications on the basically available bidet structures, the present invention is another modified structure of my Philippine Patent Nos. 20050 and 20051 both issued on Sep. 18, 1986.

The operating mechanism of said issued patents disclosed a lever operated spring-based valve enclosed in a casing. Though generally accepted with satisfaction by the end-user, they have however, several preshaped components.

Accordingly, it is therefore, a primary object of invention to provide a bidet apparatus for use in toilet fixtures having a modified valve operated mechanism detachably secured on a mounting bracket, said casing and bracket being more simpler and economically manufactured. Another object of the invention is to provide a bidet apparatus having valve operated mechanism defining a water inlet and outlet which conveys fluid into the flush tank or to directable spray nozzle.

Still another object of the invention is to provide a bidet apparatus which utilized a very simple valve component and water ductway and/or passageway.

A further object of the invention is to provide a bidet apparatus that could be easily installed in any conventional toilet bowl and having a directable spray nozzle that is adjustable to the desired angle of inclination thereby directing properly the trajectory of the water sprayed to the selected, localized area of the rectal portion of the body.

Other objects and advantages of the invention will be apparent to the following detailed description taken in conjunction with the appended drawings.

IN THE DRAWINGS

FIG. 1 is a perspective view of the bidet apparatus as operably installed in conjunction with the conventional toilet bowl and flush tank;

FIG. 3 is a cross-sectional view taken along line 3—3 of FIG. 1;

Figure 2:
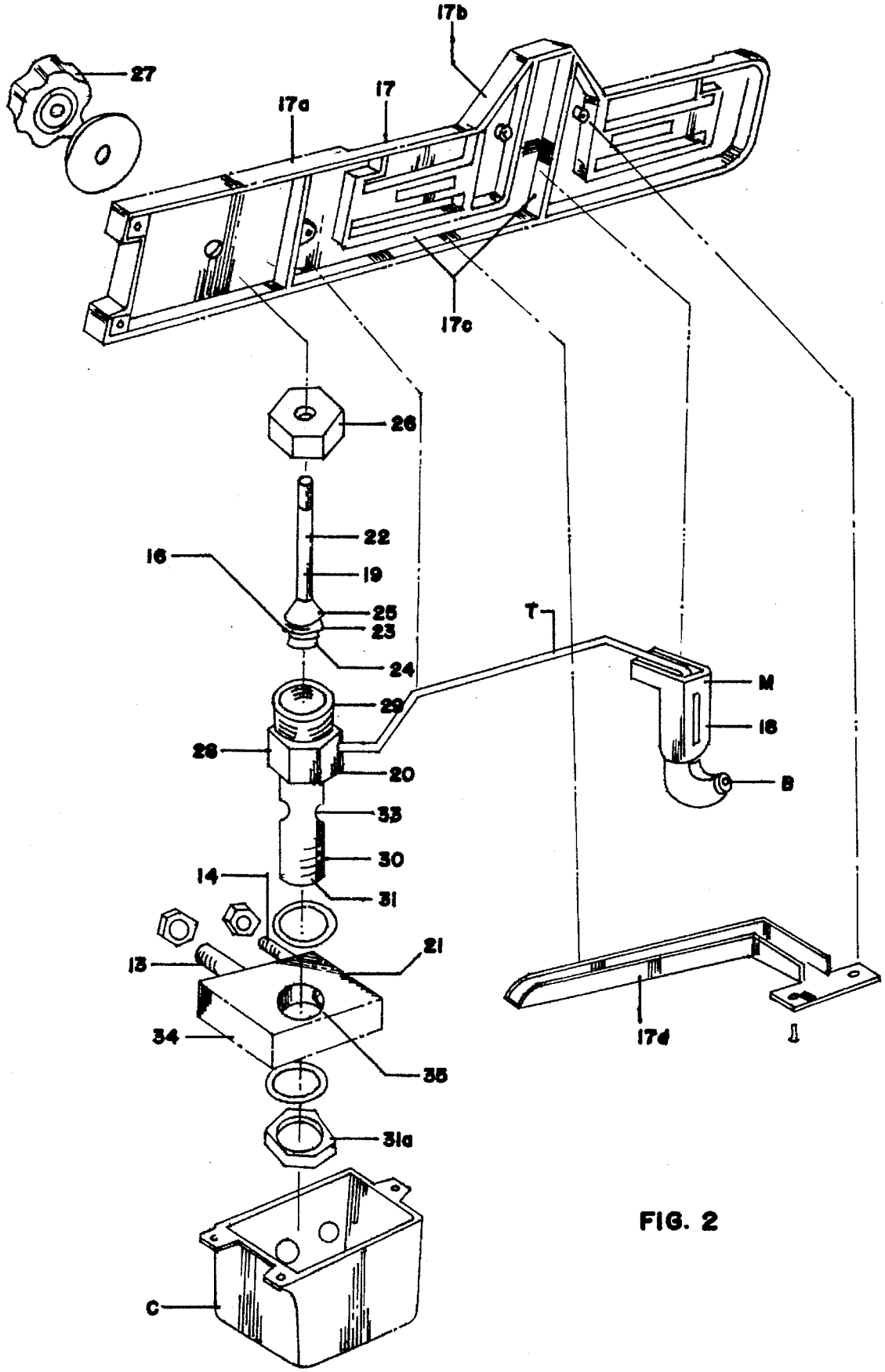
FIG. 2 is an exploded view of the apparatus.

Referring now in detail to the drawings, in FIG. 1, the bidet apparatus generally designated as 10 is shown being mounted at the rear end of a toilet bowl 11 through the conventional toilet seat hinge or pin 12. Said bidet 10 has an inlet conduit 13 connected to a water supply source S and an outlet conduit 14 connected to the inlet pipe P of the float-controlled flush tank 15.

The bidet apparatus 10 essentially comprises a valve operated mechanism 16, an elongated rectangular mounting bracket 17 extending laterally on top of said mechanism 16 and being detachably secured at the rear end of said toilet bowl 11, and a directable spray nozzle 18 in communication with said mechanism 16 and vertically disposed on the extended section of said bracket 17 and within the confines of said toilet bowl 11.

Figure 4:
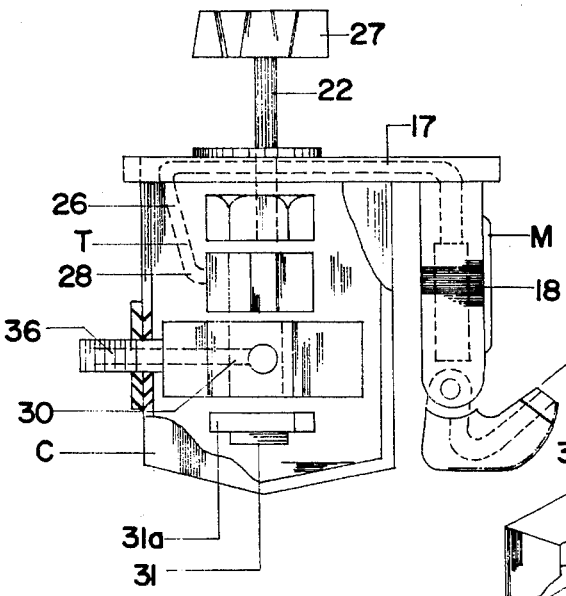
FIG. 4 is a side elevational view, partly sectioned, showing the assembled apparatus.

As best illustrated in FIGS. 2, 3 and 4, the valve operated mechanism consists of a valve regulator 19, an elongated valve seat housing 20 screwably connected on said regulator 19 and a rectangular water conveyance block 21 detachably secured on the lower portion of said housing 20 and communicably thereof.

The valve regulator 19, as in conventional structures defines an elongated stem 22 with an externally threaded and diametrically larger lower portion 23. A washer seal 24 and 25 is spacedly secured between said threaded portion 23 and an internally threaded hexagonal cap or nut 26 is provided to detachably retain the valve regulator 19 with the valve seat housing 20. Suitable control knob 27 is fitted on top of said stem 22. The valve seat housing 20 internally includes an internally threaded hexagonal body 28 having an externally threaded neck portion 29 and an elongated hollow shaft portion 30 oppositely extending therefrom. Said nut 26 being fitted with a rubber seal 25 is adapted to be screwably secured to the neck portion 29 of said valve seat housing 20. The said hollow shaft portion 30 has a closed and externally threaded lower end 31. Formed within the upper part of said shaft portion 30 is a shoulder to define a valve seat 32. Transversely drilled on said shaft portion 30 and oppositely extending therethrough is a pair of water leading hole 33. Transversely fixed on said hexagonal body 28 and in communication with the said water leading hole 33 is the elongated bidet conveyance tube T. Formed on the other end of this tube T is the directable spray nozzle 18. It maybe noted that this nozzle 18 is fitted with an L-shaped hanger member M with an adjustable bidet sprayer member B which is so structured in the same manner with the disclosed Philippine Patent No. 20051 issued on Sep. 18, 1986.

Figure 5:
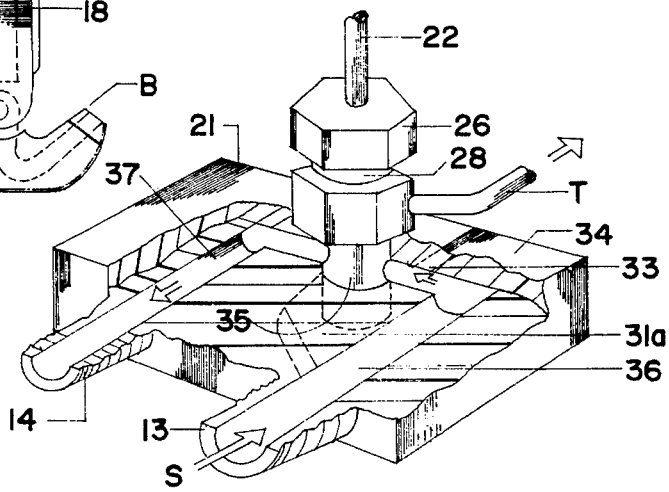
FIG. 5 is an isolated perspective view, partly sectioned, of the fluid ductway in relation with the valve operated mechanism.

As best illustrated in FIGS. 3 and 5, the water conveyance block 21 defines a rectangular body 34 of plastic material having a circular opening 35 transversely disposed and centrally proximate the longitudinal edge thereof. This opening 35 is adapted for extendingly receiving the hollow shaft portion 30 of said valve seat housing 20. Spacedly formed within said block 21 and communically thereof is the L-shaped inlet and outlet ductways and/or passageways 36 and 37. This passageways communicates with each other through the leading hole 33 formed on the shaft portion 30 of said valve seat housing 20. Each of said passageways 36 and 37 is provided with the said outwardly extending externally threaded inlet conduit 13 and 14, respectively.

The mounting bracket 17 defines an elongated channeled body of plastic material 17*a* having an ear-like projection 17*b* on the front longitudinal portion thereof. Formed on the bottom rear end of said bracket 17 is an L-shaped channel portion 17*c* so as to receive said bidet conveyance tube T and the upper portion of the bidet directable spray nozzle 18. A complementary L-shaped channelled cover 17*d* substantially secure said bidet's tube T and nozzle 18.

Suitable nut 31*a* secure the lower end of shaft 31, and a casing c secures the valve mechanism 16 with the bracket.

Figure 6A:
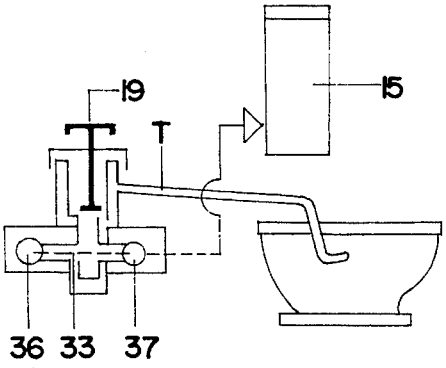
FIGS. 6(A) and (B) is an schematic diagram showing the fluid flow in operating the bidet apparatus.
Figure 6B:
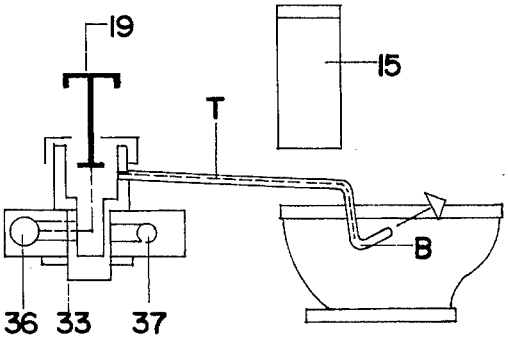

In operation, as best illustrated in FIGS. 5 and 6, when the valve is closed as shown in FIG. 6(A), the inflow of water from the supply source S is conveyed through the inlet passageway 36, the leading hole 33, the outlet passageway 37 and then directly into the flush tank 15. When the valve is open as shown in FIG. 6(B) the inflow of water from the supply source is conveyed through the inlet passageway 36, the leading hole 33, the bidet conveyance tube T and directly into the bidet sprayer B for hygienic rectal spraying. It maybe noted that water spraying depends on the pressure of the supply source such that when there occurs a very high pressure of water supply, the supply of water to the bidet sprayer B together with the flush tank 15 could be attained.

I claim:

1. A bidet apparatus for use with a toilet having a bowl and a tank, said apparatus comprising:

an elongated mounting bracket adapted to be secured to the toilet bowl;

a spray nozzle mounted to one end portion of said bracket;

a valve mechanism mounted to the other end portion of said bracket, said valve mechanism including an elongated hollow valve housing defining an externally threaded neck portion at one end thereof, a closed tubular portion at the other end thereof having a pair of transverse holes therethrough, and an internally threaded portion, said valve mechanism further including a valve seat formed between said internally threaded and tubular portions and a valve regulator threadably engaging said internally threaded portion and engageable with said valve seat;

a water conveyance tube in communication with said internally threaded portion and said spray nozzle; and a water conveyance block mounted on said tubular portion, said block including respective passageways communicating with said transverse holes, one of said passageways for connection to a source of water and the other of said passageways for connection to a refill valve of the toilet tank.

2. A bidet apparatus as claimed in claim 1 wherein said water conveyance block defines a body having an opening for reception of the tubular portion of said valve seat housing, said passageways being L-shaped and each having an externally threaded conduit.

* * * * *